US005441323A

United States Patent [19]

Goddard

[11] Patent Number: 5,441,323

[45] Date of Patent: Aug. 15, 1995

[54] CARRIER FOR BAGS HAVING STRAPS AND METHOD OF USE

[76] Inventor: Scott H. Goddard, 230 1/2 Hampton Dr., Venice, Calif. 90291

[21] Appl. No.: 319,613

[22] Filed: Oct. 7, 1994

Related U.S. Application Data

[63] Continuation-in-part of Ser. No. 169,161, Dec. 17, 1993, abandoned.

[51] Int. Cl.[6] ..... B65D 33/06

[52] U.S. Cl. ..... 294/158; 294/137; 294/166

[58] Field of Search ..... 294/26, 137, 142, 143, 294/148, 153, 158, 159, 162, 163, 165–167, 170, 171; 16/114 R, 114 B; 383/6, 13, 15, 25, 26, 29

[56] References Cited

U.S. PATENT DOCUMENTS

| | | | |
|---|---|---|---|
| 280,434 | 7/1883 | Zahm | 294/158 X |
| 816,473 | 3/1906 | Johnson | 294/158 |
| 2,592,389 | 4/1952 | Budy | 294/166 X |
| 4,112,541 | 9/1978 | Tetradis | 294/165 |
| 4,301,575 | 11/1981 | Goldberg | 294/158 X |
| 4,656,771 | 4/1987 | Holmes | 294/166 X |
| 4,772,059 | 9/1988 | Parry et al. | 294/170 |
| 5,181,757 | 1/1993 | Montoya | 294/170 X |
| 5,263,755 | 11/1993 | Thompson | 294/137 X |

FOREIGN PATENT DOCUMENTS

| | | | |
|---|---|---|---|
| 447994 | 4/1948 | Canada | 294/158 |
| 558835 | 6/1958 | Canada | 294/158 |
| 7888 | 2/1980 | European Pat. Off. | 294/137 |
| 2588481 | 4/1987 | France | 294/156 |
| 2632933 | 12/1989 | France | 294/153 |
| 2659626 | 9/1991 | France | 294/137 |
| 249373 | 7/1972 | Germany | 294/137 |
| 93785 | 3/1922 | Switzerland | 294/137 |
| 21505 | of 1913 | United Kingdom | 294/137 |
| 113180 | of 1918 | United Kingdom | 294/158 |

*Primary Examiner*—Johnny D. Cherry
*Attorney, Agent, or Firm*—Timothy T. Tyson; Ted Masters; Hornbaker & Rosen Freilich

[57] ABSTRACT

A carrier 20 and method for carrying bags having carrying straps wherein a tongue 32 guides the carrying straps 100 into the carrier 20. A recess 46 limits any shifting motion of the carrying straps 100 within the carrier 20 and is positioned along the centerline of the forearm of the user. The handle 40 of the carrier tilts downward 14° in use to match the natural angle of the curved fingers grasping the carrier and together with the positioning of the recess allows the bags or other articles to be comfortably aligned with the centerline of the forearm with a minimum of flexing of the wrist. A ring-shaped clasp 30 locks the carrying straps 100 within the carrier 20.

25 Claims, 5 Drawing Sheets

FIG.3
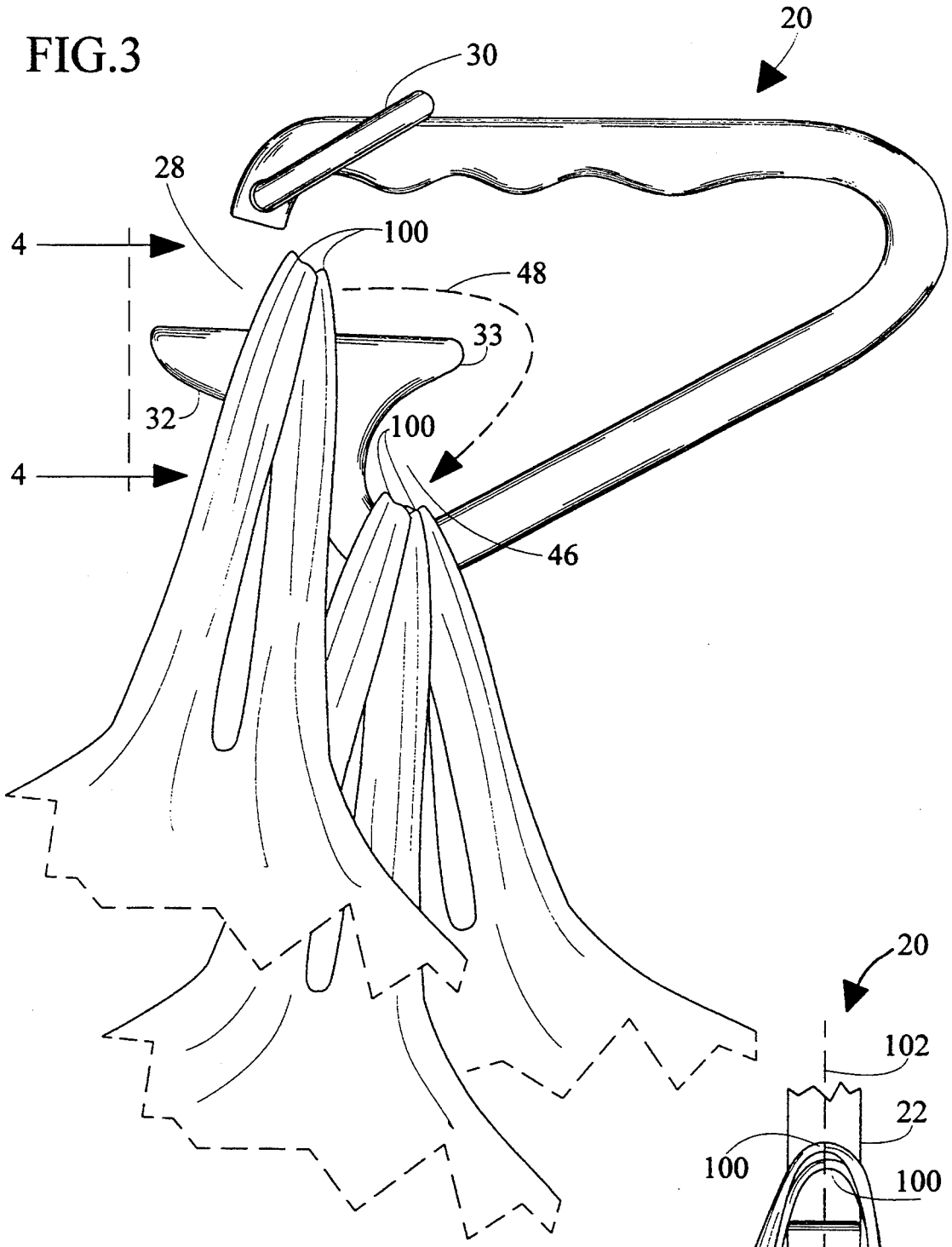
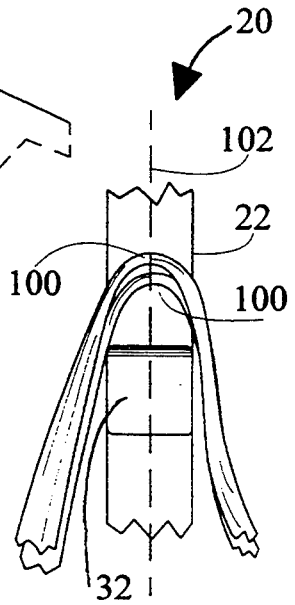
FIG. 4

CARRIER FOR BAGS HAVING STRAPS AND METHOD OF USE

CROSS-REFERENCE TO RELATED APPLICATION

This is a continuation-in-part of application Ser. No. 08/169,161, filed Dec. 17, 1993, now abandoned, the disclosure of which is incorporated herein by reference.

TECHNICAL FIELD

The present invention pertains to carriers for carrying bags or other articles having carrying straps or the like, and more particularly to a carrier and method of carrying wherein a tongue guides the carrying straps into the carrier, and a recess limits any shifting motion of the carrying straps within the carrier.

BACKGROUND ART

Devices for carrying one or more bags or other articles having carrying straps have been known in the art for many years. Each of these carrying devices employs some form of handle with which to hold the carrying device, and a holder portion which is inserted through and captures the carrying straps. For example, U.S. Pat. No. 816,473 shows a carrier designed primarily for carrying one of more pick-heads or similar tools. The carrier is constructed of a single length of material bent near one end to provide a supporting loop, and bent near the other end to provide a head carrying stem. U.S. Pat. No. 2,592,389 defines a stringer and carrier for fish, game or other objects. The device includes a handle, and a stringer loop having a barb which prevents the contents of the loop from slipping off. U.S. Pat. No. 4,112,541 depicts a handle for bags particularly of net or plastic material. The handle has a closed loop carrying member to the bottom portion of which is connected a bendable strip. Detents and mating recesses are provided on the opposed inner faces of the strip portions to clamp the bag in place. U.S. Pat. No. 4,772,059 discloses a carrying member for carrying items such as grocery bags and parcels. The carrying member includes an upper pressure distribution gripping portion and a lower handle receiving region. U.S. Pat. No. 5,263,755 constitutes a portable carrier for plastic, net or canvas bags which has an elongated handle section with hinge bosses fixed at the breech end, that is connected to an elongate connecting arm tongue with a hinge pin. British Patent 113,180 describes an improved device for enabling parcels and other objects to be readily carried by hand. The carrier includes two limbs that are connected together at one of their ends, the upper limb is fitted with a handle, and the lower limb can support one or more parcels. Canadian Patent 558,835 consists of a bag handle having a removable holding component. The bag handle includes a single length of resilient metal having a straight portion and a curved holding portion. French Patent 2,659,626 shows a carrying handle for bags issued to customers of large self-service stores. The carrying handle includes a body having an aperture in which a fastener pivots to be seated in a notch, thereby locking the bags within the carrying handle.

In contrast to the present invention, none of the aforementioned carrying devices incorporate an outwardly protruding tongue specifically designed to guide the carrying straps into the carrier. Nor do any of the prior art devices incorporate a recess which limits any shifting motion of the carrying straps within the carrier.

DISCLOSURE OF INVENTION

The present invention is directed to an improved carrier and method for carrying bags or other articles having carrying straps or the like. The carrier is suitable for use with bags or other articles fabricated from plastic, net, cloth, or even items of solid construction so long as the bags or other articles is provided with one or more carrying straps or handles. The carrying straps of one or more bags or other articles are inserted into the carrier, and then the carrier is closed by squeezing the carrier and engaging a closure means which locks the carrying straps in place within the carrier. The carrier holds the carrying straps of the bags or other articles together in an organized bundle so they can be carried or put down without becoming disconnected or spilling.

In accordance with a preferred embodiment of the invention, the carrier includes an elongated body which is shaped to form a carrying strap receiving aperture. A closure means allows selective closing of the aperture to lock the carrying straps in place within the carrier.

In accordance with another preferred embodiment of the invention, the carrier includes an outwardly protruding tongue for guiding the carrying straps through the aperture and into the carrier. The tongue includes an inwardly projecting heel.

In accordance with another preferred embodiment of the invention, the carrier includes a hook shaped recess sized to receive one or more carrying straps. The recess limits any shifting motion of the carrying straps within the carrier, and further bonds the bodies of the bags or other articles into a single stable mass.

In accordance with an important aspect of the invention, the combination of the tongue's heel and the recess serves to capture the carrying straps as they are installed in the carrier, thus preventing already installed carrying straps from unwantedly exiting the carrier.

In accordance with another important aspect of the invention, the carrier is fabricated from a resilient material wherein the carrier can be squeezed, thus reducing the aperture and allowing engagement of the closure means.

In accordance with an important feature of the invention, the carrier includes a handle portion sized to be grasped by the four fingers of a human hand in a pistol grip fashion.

In accordance with another important feature of the invention, the location of the recess results in the carrying straps and attached bags or other articles being comfortably aligned along the centerline of the forearm and hand of the user.

In accordance with another important feature of the invention, the handle portion is tilted 14° from horizontal toward the recess matching the natural angle of the fingers curved around the handle portion when the person is carrying bags with the carrier.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 3 is a side view of the carrier receiving a plurality of carrying straps;

FIG. 4 is a fragmented end view taken along the line 4—4 of FIG. 3;

MODES FOR CARRYING OUT THE INVENTION

Figure 1:
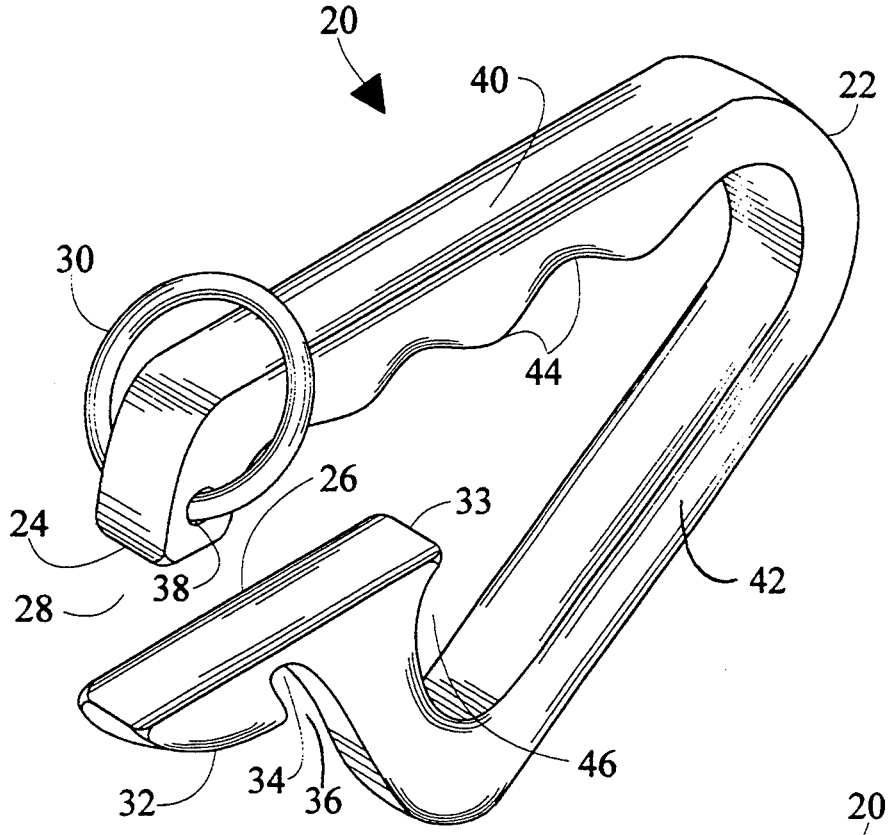
FIG. 1 is a perspective view of the carrier in accordance with the present invention.
Figure 2:
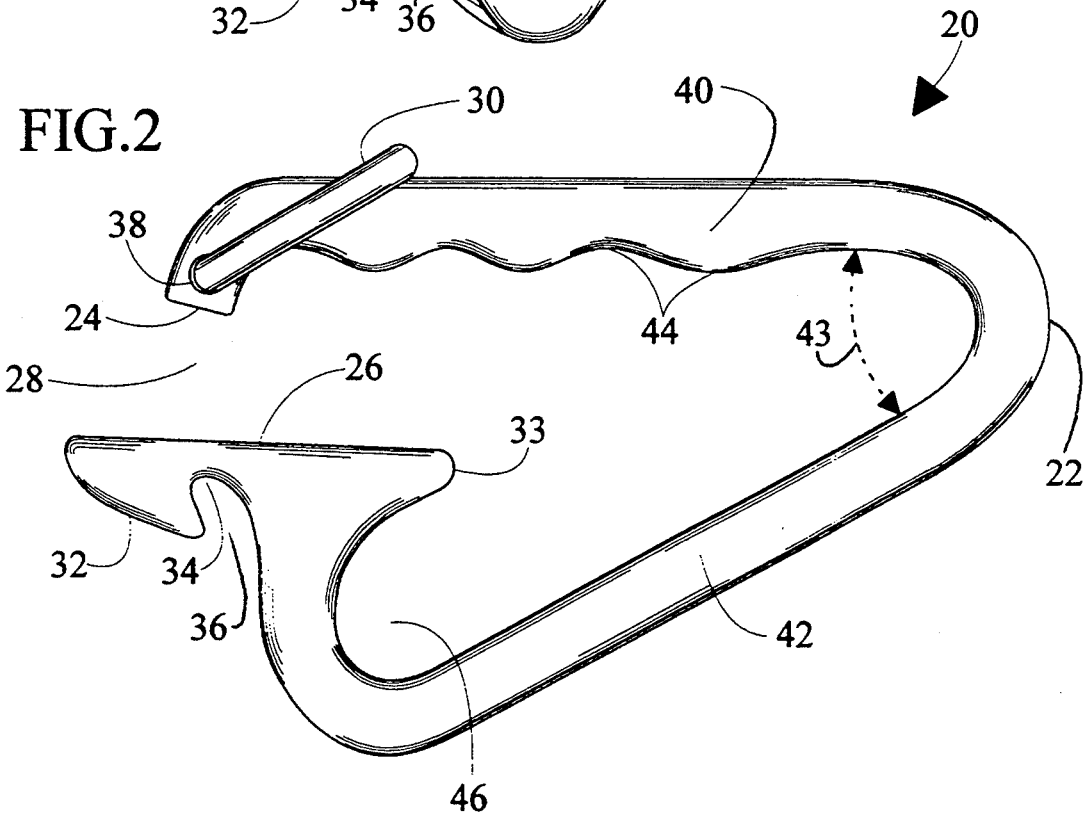
FIG. 2 is a side view of the carrier.
Figure 6:
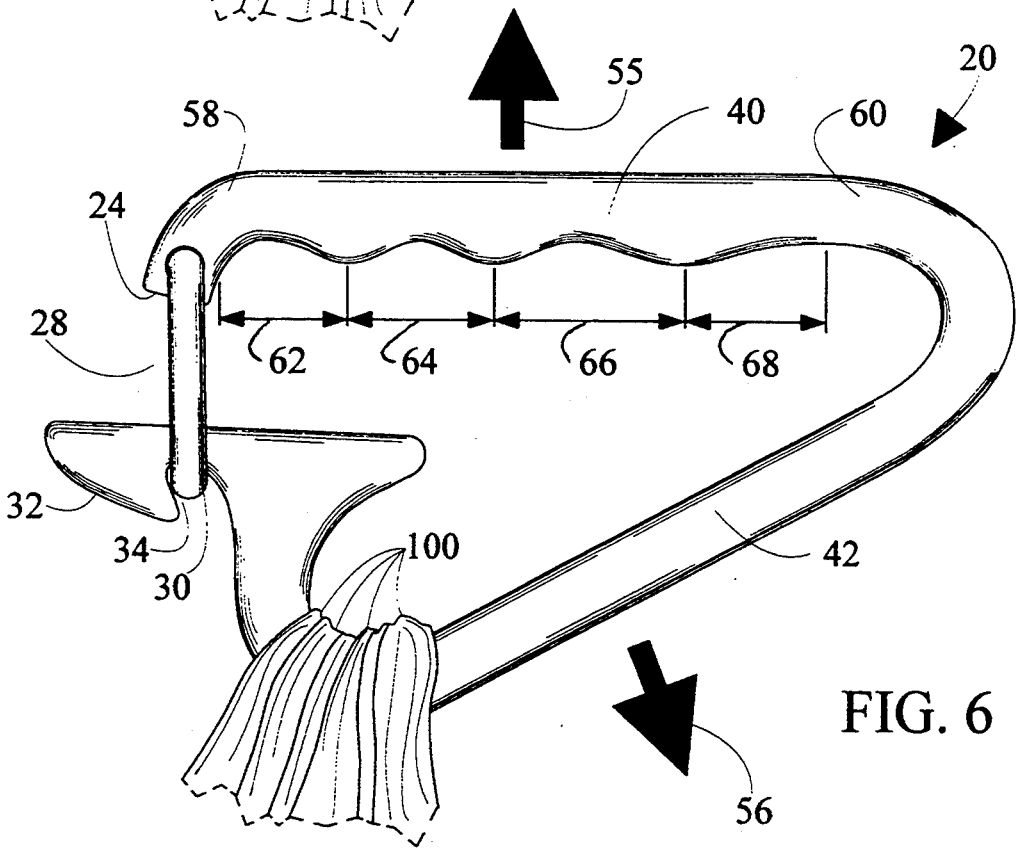
FIG. 6 is a side view of the carrier showing the closure means in the closed position.

Referring initially to FIG. 1 and FIG. 2, there are illustrated a perspective view and a side view respectively of a carrier in accordance with the present invention, generally designated as 20. The carrier 20 consists of an elongated body 22 having a first end 24 and a second end 26 opposite first end 24. Body 22 is shaped to form an aperture 28 between first end 24 and second end 26. Aperture 28 has an open configuration sized to receive the carrying straps 100 (FIG. 3). A closure means connected to body 22 permits selective closing of aperture 28. The closure means has an open position, a closed position, and a cocked position. In the embodiment shown, the closure means includes a ring shaped clasp 30 which is pivotally connected to body 22 at a point adjacent to first end 24 and a notch 34 on second end 26 with a mouth 36 that opens away from first end 24. Clasp 30 is shown in the open position. FIG. 6 shows clasp 30 in the closed position. Clasp 30 is fabricated from metal or other rigid material. Other closure means such as clips, belts, straps, or bands could also be employed to close aperture 28.

An outwardly protruding tongue 32 is integral with second end 26, and is used to guide the carrying straps 100 through aperture 28. Body 22 is substantially planar being aligned with plane 102 (FIG. 4). Body 22 has a traverse hole 38 located at a point adjacent first end 24. Traverse hole 38 is substantially perpendicular to plane 102 (FIG. 4). Clasp 30 engages traverse hole 38 so that clasp 30 is free to pivot around first end 24 and tongue 32 to engage notch 34. Body 22, tongue 32, and the closure means have blunt edges and corners so as not to rip, cut, tear or otherwise damage the carrying straps.

Body 22 includes an elongated substantially straight handle portion 40 adjacent the first end 24, and an elongated substantially straight holder portion 42 adjacent the second end 26. Handle portion 40 and holder portion 42 form an acute angle of approximately 28° indicated by arrows 43. Handle portion 40 is sized to be grasped by the four fingers of a human hand in a pistol grip fashion. Handle portion 40 has an inner surface facing toward holder portion 42. Finger fitting contours 44 are disposed on the inner surface of holder portion 42 making the handle portion more comfortable for the user and minimizing the possibility of slippage of the hand along the handle portion. Second end 26 is curved toward first end 24 thereby forming a hook shaped recess 46 sized to receive at least one carrying strap 100. Tongue 32 includes an inwardly projecting heel 33 that is adjacent to recess 46.

FIG. 3 is a side view of the carrier 20 receiving a plurality of carrying straps 100. Clasp 30 has been placed in the open position to permit access to aperture 28. Tongue 32 is first used to penetrate the opening in the carrying straps 100. Tongue 32 is then used to guide the carrying straps 100 of at least one bag or other article through the open configuration of aperture 28 and into the carrier 20 in direction 48. When the carrying straps 100 reach heel 33 of tongue 32, they are positioned, manually or by the force of gravity, into recess 46. The combination of recess 46 and heel 33 is extremely useful in that this design tends to capture the carrying straps 100 as they enter the carrier 20, thus preventing already installed carrying straps 100 from unwantedly exiting the carrier 20 as subsequent carrying straps 100 are installed. Recess 46 affords another advantage in that it is small and has a tight curvature. Therefore, the recess limits any shifting motion of the carrying straps within the carrier. Shifting is undesirable as it could contribute to bag motion and possible spillage or rupture during transport. Similarly, recess 46 forces the carrying straps 100 of all bags or other articles into close proximity. This in turn causes the bodies of the bags or other articles to be more closely bonded by friction into a single stable mass and therefore reduces individual bag motion.

FIG, 4 is a fragmented end view along the line 4—4 of FIG. 3. The carrying straps 100 are guided by tongue 32 into the carrier 20. Body 22 is substantially planar being aligned with plane 102.

Figure 5:
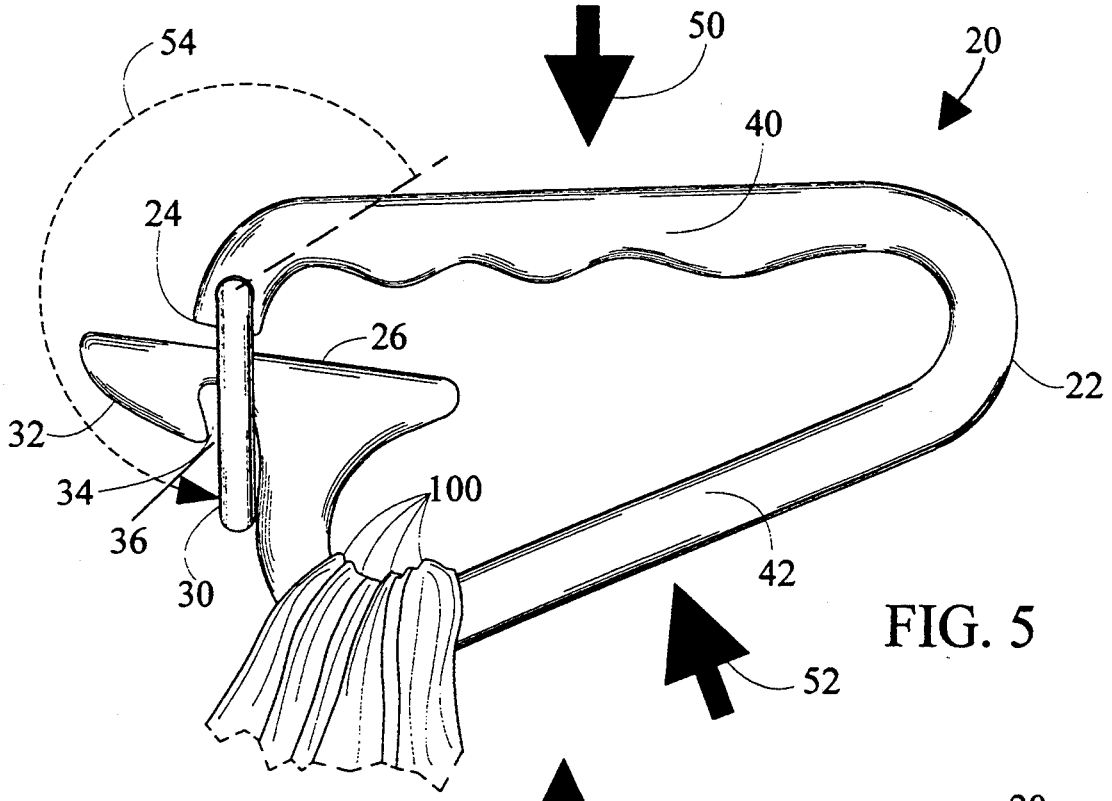
FIG. 5 is a side view of the carrier showing the handle portion and the holder portion squeezed together.

FIG. 5 is a side view of carrier 20 showing handle portion 40 and holder portion 42 squeezed together. Body 22 is fabricated from a resilient material such as plastic. Polyurethane has been found to be useful. A spring action between handle portion 40 and resiliently connected holder portion 42 allows first end 24 and second end 26 to be manually squeezed together in directions 50 and 52 respectively. Clasp 30 has been pivoted around tongue 32 in direction 54 to the cocked position near mouth 36 of notch 34.

FIG. 6 is a side view of carrier 20 showing the closure means including clasp 30 and notch 34 in the closed position. The squeezing action has been discontinued and handle portion 40 and holder portion 42 have resiliently returned to their original positions in directions 55 and 56 respectively. This causes the closure means (clasp 30) to engage notch 34 and assume the closed position which closes aperture 28 between tongue 32 and handle portion 40. The carrying straps 100 are thereby locked in place within the carrier 20.

While the resilient embodiment is found to be useful, other methods of selectively closing the aperture 28 could also be employed such as a spring loaded hinge. In addition, it will be appreciated from FIG. 3 that no closure means is essential because the overall design of the carrier 20 tends to keep the carrying straps 100 in the carrier even without a closure means.

Figure 7:
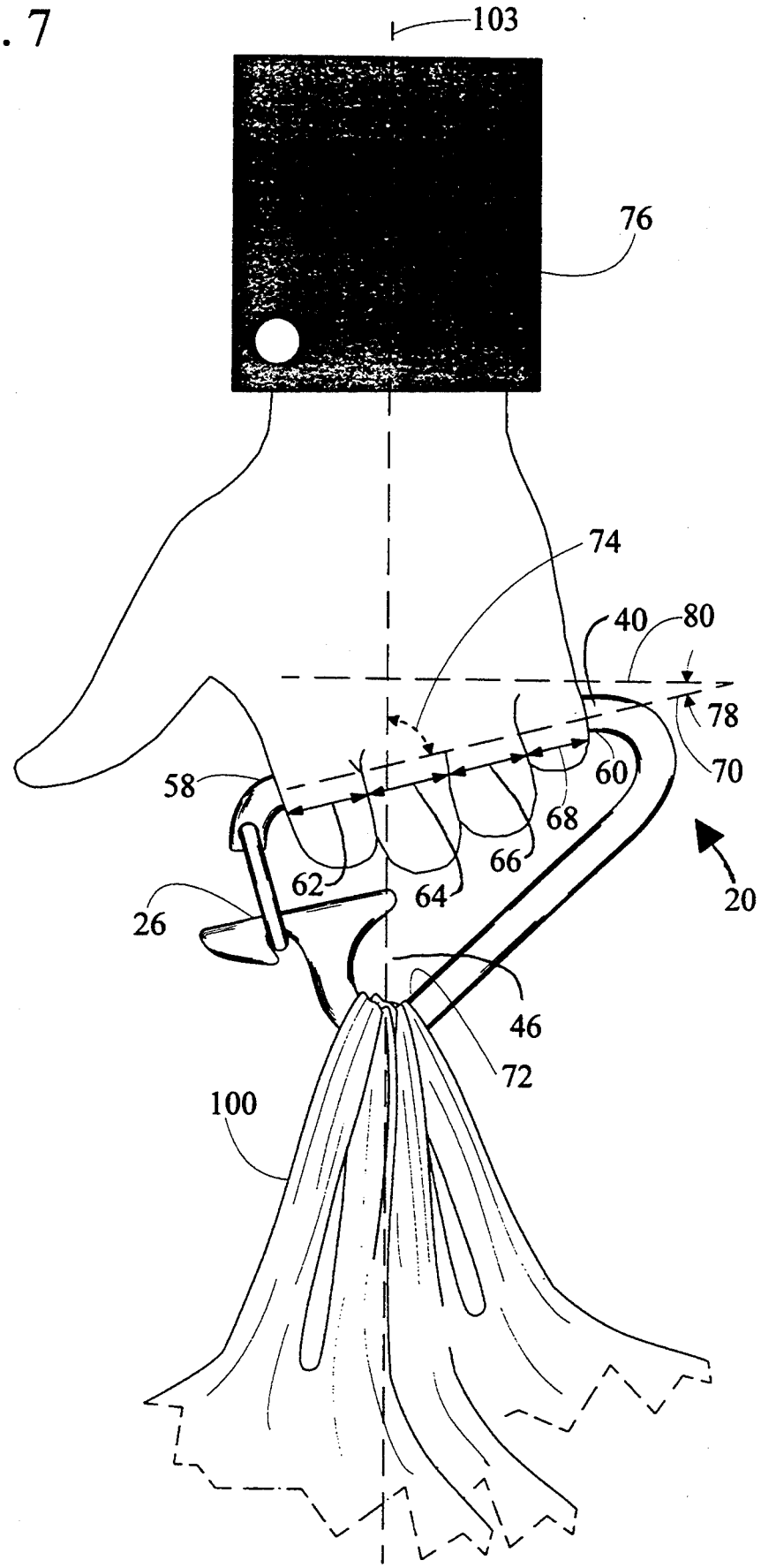
FIG. 7 is a reduced side view of the carrier showing the carrier being used to carry bags or other articles; and, FIG. 8 is a reduced perspective view of the carrier in use.

FIG. 7 is a reduced side view of the carrier 20 being used to carry bags or other articles having carrying straps 100. Handle portion 40 of carrier 20 is grasped by the four fingers of the hand in a pistol grip fashion. The line 103 represents the centerline of the forearm 76. In order to minimize stresses on the hand, wrist, and forearm, the recess 46 of the carrier 20 is positioned along the line 103 and the handle portion 40 is tilted 14° below horizontal (line 80) represented by the arrows 78 toward the recess to match the natural angle of the fingers. The center of gravity of the load of bags suspended from the carrier is then also substantially along the center line 103. The configuration of the carrier 20 thereby minimizes the need for any wrist flexure when the user is carrying a load.

In order to achieve this preferred configurations the carrier 20 is constructed with a 76° angle between the handle portion 40 and the recess 46. Specifically, the thumb end 58 of the handle portion is spaced from the heel end 60. Between the thumb end 58 and heel, end 60 are an index finger segment 62, a middle finger segment 64, a ring finger segment 66, and a little finger segment 68 (also shown in FIG. 6). The handle portion 40 has a handle axis 70. The recess 46 has a bottom surface 72. The preferred construction is achieved by positioning the recess 46 so that the centerline 103 bisects the bottom surface 72 while also intersecting the handle axis 70 in the middle finger segment 64 at an angle of substantially 76° represented by arrows 74.

Figure 8:
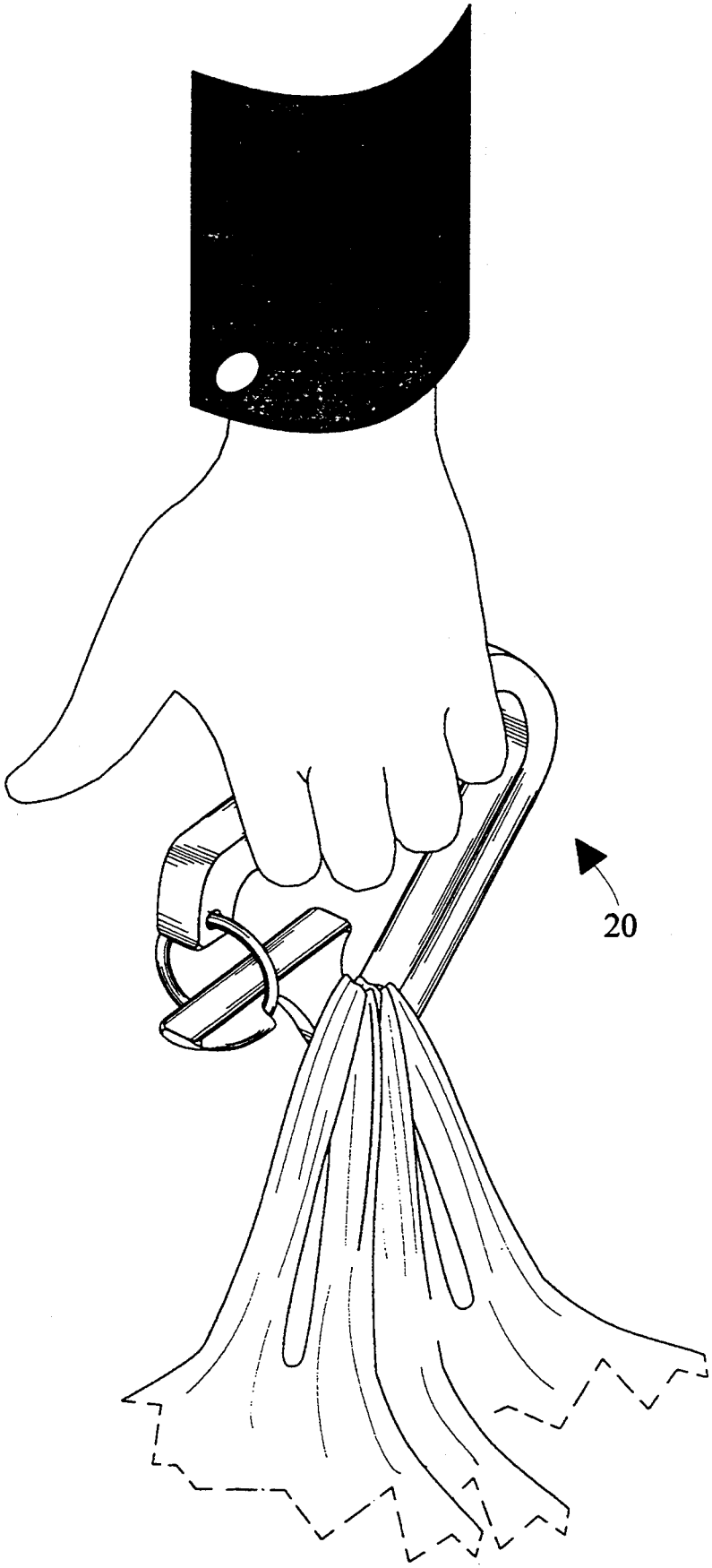

FIG. 8 is a reduced perspective view of carrier 20 in use.

The preferred embodiments of the invention described herein are exemplary and numerous modifications, dimensional variations, and rearrangements can be readily envisioned to achieve an equivalent result, all of which are intended to be embraced within the scope of the appended claims.

What is claimed is:

1. A carrier for bags or other articles having carrying straps or the like, comprising an elongated body having a first end, a second end opposite said first end, said body shaped to form an aperture between said first end and said second end, said aperture having an open configuration sized to receive the carrying straps, an outwardly protruding tongue integral with said second end for guiding the carrying straps through said aperture, and, said outwardly protruding tongue including an inwardly projecting heel.

2. A carrier according to claim 1, further comprising a closure means having:

a ring shaped clasp pivotally connected to said body through a traverse hole in said first end;

said second end having a notch with a mouth opening away from said first end; and, said body fabricated of a resilient material wherein said clasp enters said mouth when said first and second ends are forced toward each other and said clasp engages said notch when the force is removed allowing said first and second ends to return to their original positions thereby closing said aperture.

3. A carrier according to claim 1, wherein said body further includes an elongated substantially straight handle portion adjacent said first end, and an elongated substantially straight holder portion adjacent said second end, said handle portion and said holder portion forming an acute angle therebetween.

4. A carrier according to claim 3, wherein said acute angle is substantially 28°.

5. A carrier according to claim 3, wherein said handle portion is sized to be grasped by the four fingers of a human hand in a pistol grip fashion and has an inner surface facing toward said holder portion with finger fitting contours.

6. A carrier according to claim 1, wherein said second end is curved toward said first end forming a hook shaped recess sized to receive at least one carrying strap.

7. A carrier according to claim 6, wherein said body further includes:

an elongated substantially straight handle portion adjacent said first end sized to be grasped by the four fingers of a human hand in a pistol grip fashion with a thumb end adjacent said first end, a heel end spaced from said thumb end, and index finger, middle finger, ring finger, and little finger segments sequentially between said thumb and heel ends with said index finger segment adjacent said first end and having a handle axis; and, said recess spaced from said handle portion and having a bottom surface bisected by a line intersecting said handle axis in said middle finger segment at an angle of substantially 76°.

8. A carrier according to claim 7, wherein said body further includes an elongated substantially straight holder portion adjacent said second end, said handle portion and said holder portion forming an acute angle therebetween.

9. A carrier for bags or other articles having carrying straps or the like, comprising an elongated body having a first end, a second end opposite said first end, said body shaped to form an aperture between said first end and said second end, said aperture having an open configuration sized to receive the carrying straps, said second end curving toward said first end forming a hook shaped recess sized to receive at least one carrying strap, and, said recess adjacent to an inwardly projecting heel.

10. A carrier according to claim 9, wherein said body further includes:

an elongated substantially straight handle portion adjacent said first end sized to be grasped by the four fingers of a human hand in a pistol grip fashion with a thumb end adjacent said first end, a heel end spaced from said thumb end, and index finger, middle finger, ring finger, and little finger segments sequentially between said thumb and heel ends with said index finger segment adjacent said first end and having a handle axis; and, said recess spaced from said handle portion and having a bottom surface bisected by a line intersecting said handle axis in said index finger segment at an angle of substantially 76°.

11. A carrier according to claim 9, further comprising a closure means having:

a ring shaped clasp pivotally connected to said body through a traverse hole in said first end;

said second end having a notch with a mouth opening away from said first end; and, said body fabricated of a resilient material wherein said clasp enters said mouth when said first and second ends are forced toward each other and said clasp engages said notch when the force is removed allowing said first and second ends to return to their original positions thereby closing said aperture.

12. A carrier according to claim 9, wherein said body further includes an elongated substantially straight handle portion adjacent said first end, and an elongated substantially straight holder portion adjacent said second end, said handle portion and said holder portion forming an acute angle therebetween.

13. A carrier according to claim 12, wherein said acute angle is substantially 28°.

14. A carrier according to claim 12, wherein said handle portion is sized to be grasped by the four fingers of a human hand in a pistol grip fashion and has an inner surface facing toward said holder portion with finger fitting contours.

15. A method for a user to carry bags or other articles having carrying straps or the like, comprising the steps of:

providing a carrier having a handle portion resiliently connected to a holder portion, a tongue including an inwardly projecting heel, an aperture between said tongue and said handle portion, a recess adjacent to said heel, and using said tongue to guide the carrying straps through said aperture to said heel;

positioning the carrying straps into said recess;

grasping said carrier; and, using said carrier to carry the bags or other articles.

16. The method of claim 15, wherein said providing step further includes providing said recess aligned along the centerline of the forearm of the user when said carrier is grasped by the user.

17. A carrier according to claim 16, wherein said providing step further includes said carrier having an elongated handle portion adjacent said first end angled substantially 14° from perpendicular to said centerline toward said recess, and wherein said using step further includes holding the wrist in a straight line with the centerline of the forearm.

18. A carrier according to claim 17, wherein:

said providing step further includes providing said carrier with a closure means having an open position, a cocked position, and a closed position; and, further including after said providing step:

placing said closure means in said open position to permit access to said aperture; and, further including after said positioning step:

forcing said handle portion and said holder portion toward each other;

placing said closure means in said cocked position; and, discontinuing said force allowing said handle portion and said holder portion to resiliently return to their original positions causing said closure means to enter said closed position locking the carrying straps within said carrier.

19. A carrier according to claim 15, wherein:

said providing step further includes providing said carrier with a closure means having an open position, a cocked position, and a closed position; and, further including after said providing step:

placing said closure means in said open position to permit access to said aperture; and, further including after said positioning step:

forcing said handle portion and said holder portion toward each other;

placing said closure means in said cocked position; and discontinuing said force allowing said handle portion and said holder portion to resiliently return to their original positions causing said closure means to enter said closed position locking the carrying straps within said carrier.

20. A carrier for bags or other articles having carrying straps or the like, comprising an elongated body having a first end, a second end opposite said first end, said body shaped to form an aperture between said first end and said second end, said aperture having an open configuration sized to receive the carrying straps, an outwardly protruding tongue integral with said second end for guiding the carrying straps through said aperture, said body further including an elongated substantially straight handle portion adjacent said first end, and an elongated substantially straight holder portion adjacent said second end, and, said handle portion and said holder portion forming an acute angle of substantially 28° therebetween.

21. A carrier for bags or other articles having carrying straps or the like, comprising an elongated body having a first end, a second end opposite said first end, said body shaped to form an aperture between said first end and said second end, said aperture having an open configuration sized to receive the carrying straps, an outwardly protruding tongue integral with said second end for guiding the carrying straps through said aperture, said body further including an elongated substantially straight handle portion adjacent said first end, and an elongated substantially straight holder portion adjacent said second end, said handle portion and said holder portion forming an acute angle therebetween, and, said handle portion sized to be grasped by the four fingers of a human hand in a pistol grip fashion and having an inner surface facing toward said holder portion with finger fitting contours.

22. A carrier for bags or other articles having carrying straps or the like, comprising an elongated body having a first end, a second end opposite said first end, said body shaped to form an aperture between said first end and said second end, said aperture having an open configuration sized to receive the carrying straps, an outwardly protruding tongue integral with said second end for guiding the carrying straps through said aperture, said second end curved toward said first end forming a hook shaped recess sized to receive at least one carrying strap, and, said tongue having an inwardly projecting heel adjacent said recess for retaining at least one carrying strap in said recess.

23. A carrier for bags or other articles having carrying straps or the like, comprising an elongated body having a first end, a second end opposite said first end, said body shaped to form an aperture between said first end and said second end, said aperture having an open configuration sized to receive the carrying straps, an outwardly protruding tongue integral with said second end for guiding the carrying straps through said aperture, said second end curved toward said first end forming a hook shaped recess sized to receive at least one carrying strap, said body further including:

an elongated substantially straight handle portion adjacent said first end sized to be grasped by the four fingers of a human hand in a pistol grip fashion with a thumb end adjacent said first end, a heel end spaced from said thumb end, and index finger, middle finger, ring finger, and little finger segments sequentially between said thumb and heel ends with said index finger segment adjacent said first end and having a handle axis; and, said recess spaced from said handle portion and having a bottom surface bisected by a line intersecting said handle axis in said middle finger segment at an angle of substantially 76°.

24. A carrier for bags or other articles having carrying straps or the like, comprising an elongated body having a first end, a second end opposite said first end, said body shaped to form an aperture between said first end and said second end, said aperture having an open configuration sized to receive the carrying straps, said second end curving toward said first end forming a hook shaped recess sized to receive at least one carrying strap, said body further including:

an elongated substantially straight handle portion adjacent said first end sized to be grasped by the four fingers of a human hand in a pistol grip fashion with a thumb end adjacent said first end, a heel end spaced from said thumb end, and index finger, middle finger, ring finger, and little finger segments sequentially between said thumb and heel ends with said index finger segment adjacent said first end and having a handle axis; and, said recess spaced from said handle portion and having a bottom surface bisected by a line intersecting said handle axis in said middle finger segment at an angle of substantially 76°.

25. A carrier for bags or other articles having carrying straps or the like, comprising an elongated body having a first end, a second end opposite said first end, said body shaped to form an aperture between said first end and said second end, said aperture having an open configuration sized to receive the carrying straps, said second end curving toward said first end forming a hook shaped recess sized to receive at least one carrying strap, said body further including an elongated substantially straight handle portion adjacent said first end, and an elongated substantially straight holder portion adjacent said second end, said handle portion and said holder portion forming an acute angle therebetween.

* * * * *